United States Patent [19]

Rhoades

[11] Patent Number: 4,537,379

[45] Date of Patent: Aug. 27, 1985

[54] SHELVING MEANS

[76] Inventor: Reginald L. Rhoades, Box 165, Hagerstown, Ind. 47346

[21] Appl. No.: 362,024

[22] Filed: Mar. 25, 1982

[51] Int. Cl.[3] ..... E04G 5/06

[52] U.S. Cl. ..... 248/222.2; 248/244

[58] Field of Search ..... 248/222.2, 222.3, 223.4, 248/225.1, 297.2, 243, 246, 244, 235, 239, 241, 245, 247; 108/108; 211/193

[56] References Cited

U.S. PATENT DOCUMENTS

| | | | |
|---|---|---|---|
| 1,400,960 | 12/1921 | Lambert | 248/244 |
| 1,833,022 | 11/1931 | Judelson | 248/222.2 |
| 1,842,786 | 1/1932 | Kirsch | 248/225.1 X |
| 2,271,250 | 1/1942 | Buchholz | 248/222.3 X |
| 2,785,823 | 3/1957 | Zarges | 248/243 X |
| 3,280,527 | 10/1966 | Faust | 52/301 |
| 3,313,509 | 4/1967 | Lockert | 248/222.3 X |
| 3,349,414 | 10/1967 | Gutner | 248/243 X |
| 3,368,227 | 2/1968 | Underdown | 5/296 |
| 3,476,344 | 11/1969 | Pace | 248/243 X |
| 3,574,980 | 4/1971 | Keller | 248/243 X |
| 3,652,048 | 3/1972 | Hartman | 248/243 |
| 3,704,675 | 12/1972 | Bellasalma | 248/222.2 X |

FOREIGN PATENT DOCUMENTS

| | | | |
|---|---|---|---|
| 1376126 | 12/1974 | United Kingdom | 248/125 |
| 2029197 | 3/1980 | United Kingdom | 248/297.2 |

*Primary Examiner*—J. Franklin Foss

*Attorney, Agent, or Firm*—Spray, Robert A.

[57] ABSTRACT

Shelving support concepts provide convenient shelf-support at any selected height, by a vertical support member having a longitudinal slot into which is twisted a support plate having generally perpendicularly-related a slot-entering portion and an outer portion. In assembly, the slot-entering portion of the plate is inserted into the slot, and then manual twist-effort about the axis of the slots and applied to the outer plate-portion causes a tight interengagement of the support plate in the slot, thus establishing a forwardly-protruding support onto which is fitted a shelf-support bracket and shelving, the support-plate being then wholly concealed.

12 Claims, 16 Drawing Figures

SHELVING MEANS

The present invention relates to shelving, and more particularly to novel and advantageous concepts by which shelving members are supported.

More specifically, the concepts of the present invention provide an easy and no-tool assembly of a support plate to a vertical support member, at infinitely-optional heights therealong, and provide easy and no-tool adjustability of the height of individual shelves.

The concepts further provide co-operative support components on the support plate and vertical support member, such that an easy "twist-in-place" or "snap-in" procedure achieves a tight interconnection, this providing a forwardly-projecting support upon which an outer shelf-bracketmay be supported, fully concealing the support plate and leaving wholly concealed all manner of support of the outer shelf-bracket, except of course the support slots themselves, but they would likely be considered merely an ornamentation of the vertical column members rather than an interengaging support component.

The twist-in procedure achieves a sturdy and tightly interlocked support by one or more features of interengagement of the co-operative support components, as detailed herein as to several embodiments.

The nature of the inventive concepts can perhaps be best understood by a consideration of the prior art discovered on a search of Patent Office files made after the invention. The prior art found on that search were the following U.S. Patents: U.S. Pat. No. 3,368,227 of P. C. Underdown (1968); U.S. Pat. No. 3,280,527 of E. Faust (1966); U.S. Pat. No. 3,574,980 of J. R. Keller (1971); U.S. Pat. No. 3,652,048 of L. Hartman (1972); and U.S. Pat. No. 3,476,344 of E. J. Pace (1969).

The Underdown patent shows and mentions bed rail supports in the form of bracket plates, and with a slot in the bed post; but the support from the bed post comes from a "cross pin P" which is fixedly installed into the bed post, presumably by being placed in holes in the bed post, for no method of support of the cross pins is shown or mentioned. The present invention avoids such a cross pin in the support post; and by avoiding a need for one or more such fixed cross pins, the present invention avoids the cost of them and of providing their support holes, and it also provides an infinite option of support elevation not attainable in the fixed-pin construction presumably employed by Underdown.

The Faust patent has a vertical slot, presumably attaining an infinite height-adjustment option, and the slot walls are sloped to provide an overhanging effect; but the fixing of a support to the slot in the Faust device is by a screw which is threaded into a plug received in the slot to attain a frictional bind. No snap-in automatic retention is suggested or achieved, as in the present invention.

The Keller patent is a shelf bracket having a vertical support rail having a groove; but, quite in contrast to a no-screw, snap-in, and infinite-adjustment retention as in the present invention, the Keller device requires screws for retention of a movable support bracket whose height-adjustment is not infinite but rather is only that provided by a limited selection of whichever of the fixed-location holes 17 is chosen.

The Hartman device has a slot with overhanging slot-walls; but like the Faust device, the Hartman device requires the expense and bother of screws engaging a plug for frictional binding. No snap-in automatic retention involving the vertical slot is suggested.

Perhaps the least remote of the prior patents is that of the Pace patent of 1969, for indeed it shows a vertical slot for presumably infinite height-adjustment, and it employs a twisting-type of installation maneuver for retention of a support bracket by the walls of the slot.

However, the Pace device is significantly different, and disadvantageous, in contrast to the present invention, in several respects: (a) The Pace twisting-type of installation is of a double nature and effort, in contrast to that of a single-type of the present invention. This is disadvantageous as well as different, for it requires an extra installation step, and makes more difficult the initial placement of the support bracket at precisely the right elevation to achieve the desired height of the installed bracket.

Also, the Pace device differs from that of the present invention, in that (b) in Pace, the first twist of the Pace device is about an axis 90° different from that of the present invention, being a twist about an axis perpendicular to the face of the support wall rather than about the general axis of the groove which of course is parallel to the support wall of the present invention. The disadvantage of Pace in this respect is indicated below.

Further, different and disadvantageous in contrast to the present invention, the Pace device purports to (c) attain its retention by a sharpened end plate (26, 46, 76, or 106) which has to bite or cut its way into the groove walls, by the twisting effort of installation. This requires extra effort and bother of the installation, requires the cost and handling bother of a sharpened edge (28), requires a groove wall of a material which can be easily bit into in this manner, limits re-installation of a bracket at a selected position slightly different from an earlier-selected position, does not provide a snugness by the principle of resilient deformation, etc.

Thus, although the prior art is shown to have attempted infinite-adjustability, even in connection with a vertical groove and even embodying one form of a twist-type automaticness of installation, all of those concepts being conveniently present in a single patent (Pace) for over 20 years, nevertheless, for those 20 years and for an uncounted hundreds of thousands of shelf-supports manufactured thereafter, and in spite of other known concepts such as overhanging groove-walls and frictional binding by retention of a retainer component in a groove, and with resilient deformation being employed in many fields including that of these support devices, and with there being known the retaining nature of toggle-type assembly whereby one part moves past a "dead center" position of minimum dimension, in spite of all such factors, the continued failure of the prior art to achieve the particular and advantageous combination of concepts of the present invention, and the advantageous differences in concepts of this invention in comparison to those of the reference patents, show that the present invention's combination is unobvious and a departure from the various types of prior art.

The above description is of somewhat introductory and generalized form, for background of the invention and nature of its concepts. More particular details, concepts, and features are set forth in the following and more detailed description of illustrative embodiments, taken in conjunction with the accompanying drawings, which are of somewhat schematic and diagrammatic nature, and in which.

Figure 6:
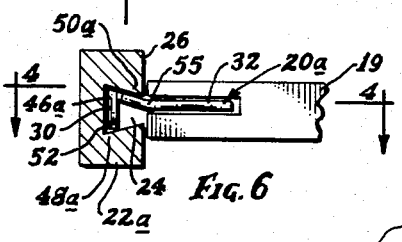
FIG. 6 is a bottom view of the shelf-support means of FIGS. 4 and 5.
Figure 7:
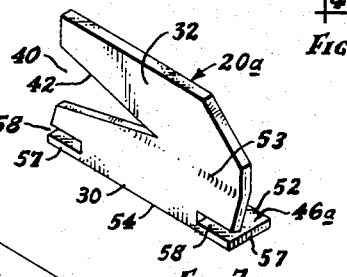
FIG. 7 is a pictorial view of a support-piece of the support means shown in FIGS. 4–6, this support-piece being referred to herein as a "first support member"
Figure 8:
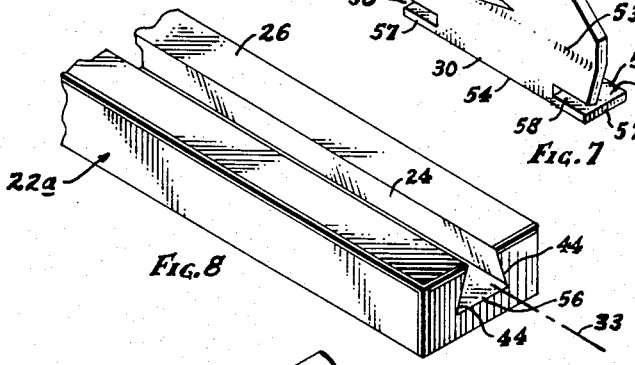
FIG. 8 is a pictorial view of the vertical wall-engaging support column member of the support means shown in FIGS. 4–6, this member being referred to herein as a "second support member;"
Figure 9:
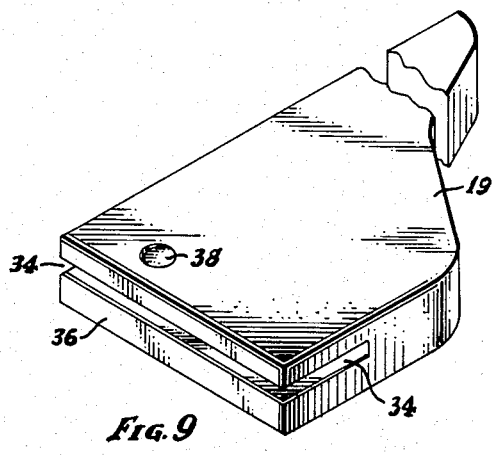
FIG. 9 is a pictorial view of a shelf-support bracket of the support means of FIGS. 4–6, but usable with the other embodiments of first and second support members as are illustratively shown in FIGS. 10–16.
Figure 13:
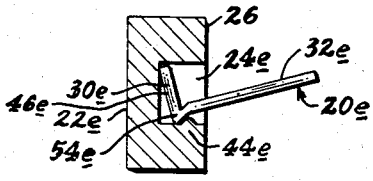
Figure 14:
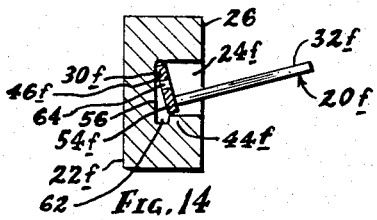
Figure 15:
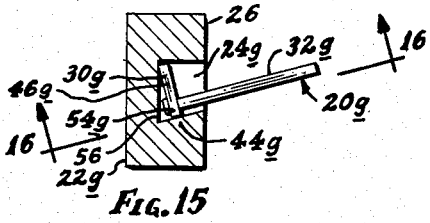
Figure 16:
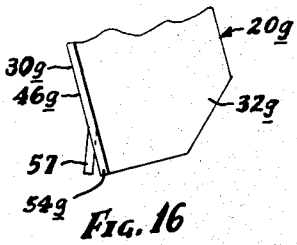

FIGS. 10–15, respectively are views similar to FIG. 6, but showing alternative embodiments of first and second support members, the first support member in all views being shown in an intermediate stage of assembly; and FIG. 16 is an auxiliary view of the first support member of the embodiment shown in FIG. 15, and viewed generally as seen by View-line 16—16 of FIG. 15.

The drawings are diagrammatic, to illustrate the concepts; and thus certain thicknesses, angles, and dimensions are somewhat exaggerated for ease of observing details, and certain views are shown fragementally or with portions shown broken away.

As shown in the drawings, the inventive concepts provide an easily-erectable set of shelving whose individual shelves 18 are mountable upon support brackets 19 at whatever height and relative spacing is desired for the particular installation; and though they are quite sturdy, the shelves of each set are easily adjustable to differing heights, or removed altogether, as desired, without leaving any scars or other evidence of the alteration.

As shown herein in various embodiments, each embodiment provides a shelf-support means by which a first support member 20 is supported by a second support member 22, the first support member 20 having various embodiments specified by different suffixes, and the second support member 22 likewise specified by various suffixes, the suffixes of both being co-ordinated according to which one of one is intended for use with the respective one of the other. Other suffixes are likewise co-ordinated to show reference to particular ones of the interengaging support members 20 and 22.

In all embodiments, the second support member 22 is provided with an elongated recess 24 opening to a face 26 of the second support member 22; and the second support member 22 would be generally vertically extending on whatever is the supporting wall 28 upon which the shelving set is to be mounted or affixed.

Figure 4:
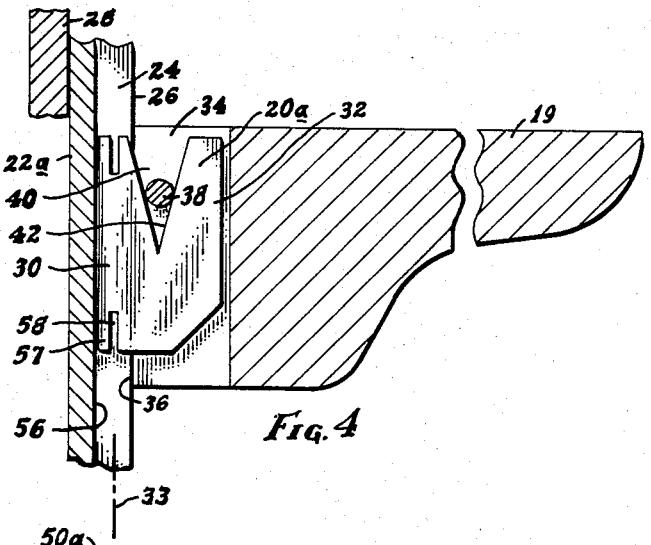
FIG. 4 is a vertical cross-sectional view, generally as taken by Section-lines-4—4 of FIGS. 5 and 6, illustrating the support of the shelf brackets from the vertical wall-engaging support column, according to one embodiment.
Figure 5:
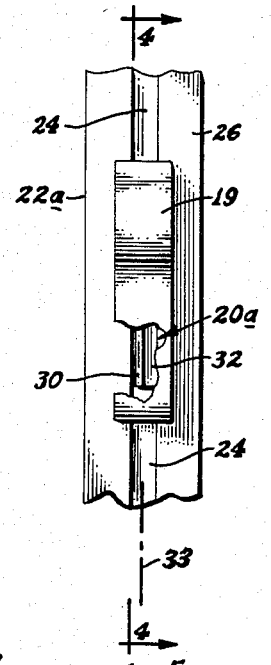
FIG. 5 is a front elevation view of the shelf-support means shown in FIG. 4.

The portion 30 of the first support member 20 which is supportively engageable with the recess 24 of the second support member 22 is such that it is insertable in a certain manner, depending upon the embodiment; but in all the embodiments shown, it is freely insertable into the longitudinal or vertical support recess or slot 24, into a first relative position therein, by first positioning that portion 30 into the recess 24. Then, without need of tools, and upon the user applying a twisting force to the outer portion 32 of the first support member 20 about the general axis 33 of the recess 24, the engageable portion 30 of the first support member 20 is caused to snugly engage the said recess 24 as the parts 20–22 are relatively moved thereby to a second relative position of firm support of the first support member 20 by the second support member 22. (The first relative position is illustrated in the drawings in FIGS. 10–15; and the second relative position by FIGS. 4–6.)

That is all the installation of the first support members 20 usually requires, and the installation may be at any height along the member 22 and its slot 24. If further tightness of fit is required, that is easily accomplished as noted below.

It will be noted that the shape of the said engageable portion 30 of the first support member 20 and the recess 24 is co-ordinated such that resilient deformation is imparted to either or both of the engageable portion 30 of the first support member 20 and/or the walls of the recess 24 by the twisting force which moves the parts 20–22 from the first relative position to the second relative position.

The shape of the engageable portion 30 of the first support member and the recess 24 is further co-ordinated such that a toggle-type retention of the engageable portion 30 of the first support member 20 is made by walls of the recess 24, by the assembly procedure's twisting force which moves the parts 20–22 from the first relative position to the second relative position.

The shelf-support brackets 19 are shown as having a recess 34 opening to their rear face 36, accommodating the entirety of the outer portion 32 of each support member 20; and transversely across an upper portion of that slot or recess 34, there is a support lug or pin 38. The pin 38 co-operates with an opening 40 in the upper end of support-plate portion 32, and more particularly with an edge 42 of that opening 40, to retain the shelf bracket 19 firmly assembled onto the sub-assembly of support members 20 and 22, the rear wall or face 36 of bracket 19 engaging the support member face 26. The upward and outer slope of plate-edge 42 achieves a tight camming effect, assuring snug support of the brackets 19 and shelves 18.

The various embodiments show various particulars of the tight interengagement of support members 20 and 22. For example, in the embodiment shown in FIGS. 4–8, with supports 20*a* and 22*a*, the walls 44 of the recess 24 are sloped, thus the wall 44 which in the second relative position of the parts is engageable with a relatively outer portion 32 of the first support member 20*a* is sloped such that it provides an undercut nature of the recess 24 into which the relatively inner portion 30 of the first support member 20*a* is received when the parts 20*a*–22*a* are in their final or second relative position.

Further, noting the embodiment shown in FIGS. 4–8, it is noted that the inner portion 46*a* of the engageable portion 30 of the first support member 20*a* is shaped such that it is operatively wider than the operative width of the recess 24 at a portion thereof intermediate its portions engaged by the first support member 20*a* in the first relative position and second relative position of the parts.

Tightness of assembly is further achieved by the provision that the recess 24 provides first and second abutments 48, 50 (i.e., 48*a* and 50*a* in FIGS. 4–8), and the first support member 20*a* having a fulcrum portion 52 which is displaced transversely of outer portions 32 of the first support member 20*a*, that portion 32 being bent as shown at 53.

Further, it is noted that the recess abutments 48*a* and 50*a* are spaced. This all provides that the first abutment 48*a* is engageable by the fulcrum or toe portion 52 of the first support member 20*a* when it and adjacent portions 30 of the first support member 20*a* (the portion to plate-heel 54) are inserted into the recess 24, the parts being then in a first assembly-stage position, the first abutment 48*a* and the fulcrum portion 52 thus providing a fulcrum, which, when the adjacent 30 and outer portions 32 of the first support member 20*a* are rotated about the general axis 33 of the recess 24 to the final or second position, forces a portion 55 of the first support member 20*a* which is removed from the fulcrum portion 52 to bear forcefully against the second abutment 50*a*.

The spacing of the two abutments 48*a* and 50*a*, and the size and shape of the fulcrum portion 52 and adjacent portions 30 of the first support member 20*a*, through and somewhat outwardly of the plate-heel 53, are such that the first support member 20*a* is firmly connected to the second support member 22*a* by compressive stress induced into the portion of the first support member 20*a* extending between the two abutments 48*a* and 50*a*.

At least one of the walls 44 of the recess 24 of FIGS. 4–8 is provided to have an undercut nature, such that when the parts are in their second or final assembly position, the walls 44 operatively bear inwardly of the face 26 of the second support member 22 and against a portion of the first support member 20, that portion of the first support member 20 being thus retained by being held between said undercut-nature wall 44 and the bottom 56 of said recess 24.

Retention is tightened, if needed, by the provision that a portion of the first support member 20*a* is provided as a tongue 57, which provides an easily bendable component which when bent achieves an operative increase in the thickness of the portion of the first support member 20 being held between the undercut nature wall 44 and the bottom 56 of the recess 24. The tongues 57 are shown as provided merely by the cutting of slits 58 in the plate-portion 30.

FIGS. 10–16 illustrate other embodiments, achieving fixed and snug interconnection of the support members 20 and 22 by means employing the basic principle of a relatively free insertion of a first portion 30 of the first support member 20 into the groove or recess 24, followed by a twisting action about the groove axis 33 to force a retention by either or both of a compression of the plate-portion 30 or of the groove walls 44, or a holding between the groove-bottom 56 and one or both of the groove-walls 44 having some sort of overhang, with a toggle-like forcing past an intermediate position of extra tightness, or into a position of compression as stated above. More particularly, the forms shown as FIGS. 10–16 are now described individually.

Figure 10:
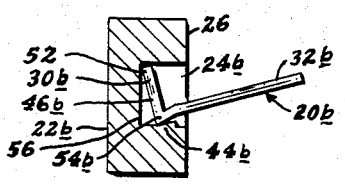

In FIG. 10, only one of the groove walls 44*b* is sloped, with a lug-like protrusion over which the heel 54*b* of plate 20*b* is forced. The size of the plate-portion 46*b* between the plate-toe 52 and plate-heel 54*b* between the recess walls 44*b* is such as to cause a jam or compressive fit when the support plate 20*b* is subsequently twisted into place (clockwise as seen in FIG. 10 to a position in which the outer plate-portion 32*b* would appear horizontal in the drawings, with the plate-foot 46*b* against the recess-bottom 56). The lug on wall 44*b* also serves to retain the tight fit.

Figure 11:
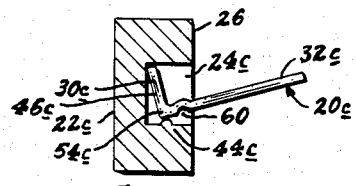

In FIG. 11, retention is shown as helped by interengagement of a lug on recess-wall 44*c* with a notch 60 in plate-wall 32*c*.

Figure 12:
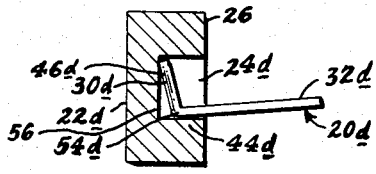

FIG. 12 illustrates an embodiment in which resilient deformation of the support-plate 20*d* is achieved when that plate 20*d* is twisted into place, aiding tight retention, by the plate-portions 32*d* and 30*d* being angled greater than that between recess-bottom 56 and the recess-wall 44*d* against which the plate-portion 32*d* bears when assembled.

FIG. 13 is an embodiment similar to that of FIG. 11 except that in FIG. 13 the toggled interengagement is by the plate-heel 54*c* extending outwardly (downwardly in the drawing) from the general plane of the plate-portion 32*e*.

FIG. 14 illustrates a different shape of wall 44*f* in comparison to that of wall 44*e* of FIG. 13, providing in effect a notch 62 into which plate-heel 54*f* is jammed.

This embodiment of FIG. 14, with plate-portion 46*f* shown in cross-section, illustrates the provision of a hole 64 (which may be provided in all embodiments) for possible use of applying a screw of nail (not shown) through the hole 64 and into the recess-bottom 56 for extra retention; and although this extra positiveness is not usually required, it may be desired in situations in which repeated assembly and dis-assembly has caused looseness of fit for one reason or another.

FIGS. 15 and 16 illustrate an embodiment in which the recess-wall 46*g* has an overhanging slope or inclination, similar to that of walls 44 in the embodiment of FIGS. 4–8, but with an extending plate-heel 54*g* in contrast to the shape (somewhat like the numeral "7") of plate 20*a* of FIGS. 4–8) and with a flat outer plate-portion 32*g*.

This embodiment of FIGS. 15 and 16 also shows the tongue 57 having been bent inwardly prior to assembly, providing that its engagement with recess-bottom 56 will cause a resilient deformation of the tongue 57 when the assembly is achieved, as in all embodiments, by manually twisting the support-plate 20*g* (clockwise) into its assembled location in which the plate-portion 32*g* appears horizontal on the drawing, i.e., perpendicular to the outer wall 26 of the vertical support member 22*g*. (This also illustrates the use of the tongue 57 in the other embodiments, as an extra means assuring tightness, resilient deformation, etc., of the interengagement of support members 20 and 22.)

In all embodiments, one or more factors of a jam-fit and/or resilient deformation, "binding-in," rivet-like overhang, and toggle-action, as indicated herein as to various embodiments, may be advantageously provided and utilized, and the twisting-in-place or snap-in assembly procedure is a characteristic of the various embodiments, even though undue repetition has been avoided where the similarity of various components seems as if it should be obvious.

Regardless of which of these embodiments illustrative of the inventive concepts is provided, the concepts provide easy, convenient, and no-tool assembly, which achieves infinite height-installation and infinite height adjustability, with snug and secure support, of a series of shelves 18 vertically-shaped throughout the entire length of the wall-mounted vertical support members 22 and their longitudinal slots 24; and after assembly of the bracket 19, each of the support plates 20 is completely concealed.

Releasability for height-adjustment is easily achieved simply by a reversal of the assembly procedures.

Figure 1:
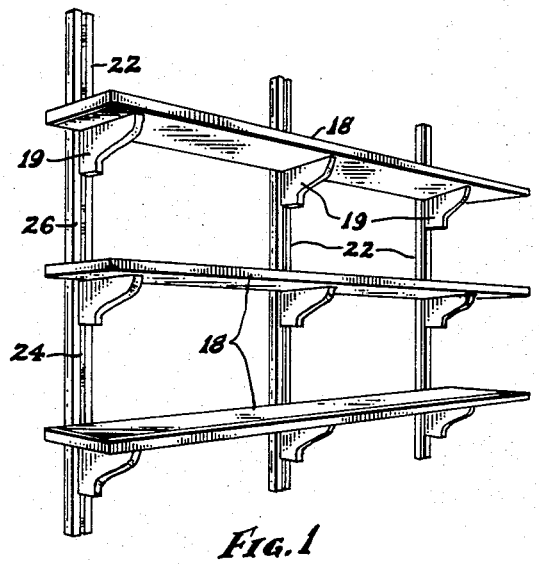
FIG. 1 is a pictorial view of a set of shelving whose horizontal object-supporting shelves are supported by support means of the present invention.
Figure 2:
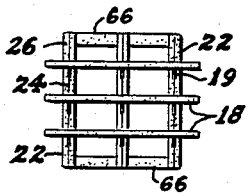
FIG. 2 is a front elevation view, in much smaller scale than FIGS. 1 and 3, of a set of support means as shown in FIG. 1 but with the vertical wall-engaging members interconnected to provide an overall frame for the shelving set.
Figure 3:
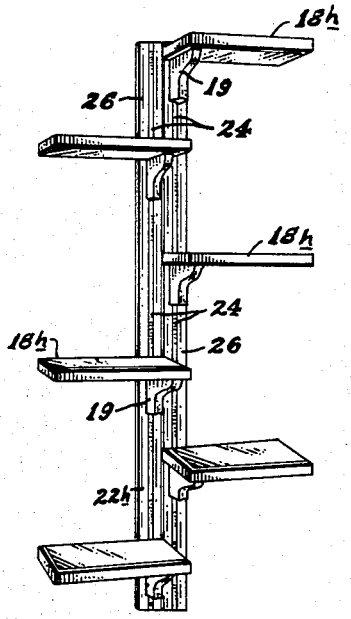
FIG. 3 is a pictorial view of a shelving embodiment in which a series of short shelf members are supported in a cantilever fashion, vertically spaced on a single vertical support column, such as for displaying individual units such as trophies, plants, etc.

Various overall shelving effects may be provided, as is illustrated by the arrangements or sets of FIGS. 1–3, FIG. 1 illustrating a conventionally-appearing set, FIG. 2 showing some frame-enclosing horizontal members 66, and FIG. 3 showing an embodiment in which a single wall-mounted (or floor mounted) support column 22*h* is provided with a pair of the grooves or slots 24, with the plate-like supports 20 (not shown in FIG. 1–3 because obscured by the brackets 19) having been affixed in the slots 24 to provide an attractive sort of staggered appearance to cantilever-supported short shelf members 18*h*.

The shelves 18 (or 18*h*) may be secured to the shelf-brackets 19 in whatever manner is desired. Such would of course be obviously necessary in the set-form shown in FIG. 3, but no connection whatever of shelves 18 to brackets 19 would be necessary in the sets shown in FIGS. 1 and 2.

It is thus seen that a shelving support structure and concepts according to the inventive concepts provides a desired and advantageous device, yielding the high appeal of an easily-assembled set of shelving without the inconvenience, bother, and tool-requirements of other shelving sets, yet providing infinite selection and adjustability of height of the shelves and the spacing thereof. The installation and subsequent conversions or other re-arrangements are convenient and easy, with little or no assembly skill or aptitude required, to achieve the desired effects; and various types of shelving arrays may advantageously utilize the present inventive concepts.

Accordingly, it will thus be seen from the foregoing description of the invention according to these illustrative embodiments, considered with the accompanying drawings, that the present invention provides new and useful concepts of shelving and shelving-support easily assembled from a kit form, and with ease of modification and interchangeability and dis-assembly, and with advantages of convenience, sturdiness, and attractiveness, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

What is claimed is:

1. Support means by which a first support member is supported by a second support member, the second support member being provided with an elongated recess opening to a face of the second support member;

the portion of the first support member supportively engageable with the said recess of the second support member being such that it is insertable freely thereinto, into a first relative position, by first positioning the said portion into the recess, and then, upon applying a twisting force to the outer portion of the first support member about the general axis of the recess, the said engageable portion of the first support member is caused to snugly engage the said recess as the parts are relatively moved thereby to a second relative position of firm support of the first support member by the second support member;

the first support member having a fulcrum portion displaced transversely of the outer portion; and a connecting portion between said outer portion and said fulcrum portion having a surface adapted to bearingly engage an undercut portion of the said elongated recess.

2. The invention as set forth in claim 1 in a combination in which the shape of the said engageable portion of the first support member and the said recess is coordinated such that a toggle-type retention of the engageable portion of the first support member is made by walls of the recess, by the twisting force which moves the parts from the first relative position to the second relative position.

3. Support means by which a first support member is supported by a second support member, the second support member being provided with an elongated recess opening to a face of the second support member;

the recess providing first and second abutments;

the first support member having a fulcrum portion displaced transversely of outer portions of the first support member;

the recess abutments being spaced, and providing that the first abutment is engageable by the fulcrum portion of the first support member when it and adjacent portions of the first support member are inserted into the recess, the parts being then in a first position, said first abutment and the said fulcrum portion providing a fulcrum, which, when the adjacent and outer portions of the first support member are rotated about the general axis of the recess to a second position, forces a portion of the first support member which is removed from the fulcrum portion to bear forcefully against the second abutment.

4. The invention as set forth in claim 3, in a combination in which the spacing of the two abutments, and the size and shape of the fulcrum portion and adjacent portions of the first support member, are such that the first support member is firmly connected to the second support member by compressive stress induced into the portion of the first support member extending between the two said abutments.

5. Support means by which a first support member is supported by a second support member, the second support member being provided with an elongated recess opening to a face of the second support member;

the portion of the first support member supportively engageable with the said recess of the second support member being such that it is insertable freely thereinto, into a first relative position, by first positioning the said portion into the recess, and then, upon applying a twisting force to the outer portion of the first support member about the general axis of the recess, the said engageable portion of the first support member is caused to snugly engage the said recess as the parts are relatively moved thereby to a second relative position of firm support of the first support member by the second support member;

the first support member having a fulcrum portion displaced transversely of the outer portion;

a connecting portion between said outer portion and said fulcrum portion having a surface adapted to bearingly engage a portion of the said elongated recess;

in a combination in which the wall of the recess, which in the second relative position of the parts is engageable with a relatively outer portion of the first support member, is sloped such that it provides an undercut nature of the recess into which the relatively inner portion of the first support member is received when the parts are in their said second relative position.

6. The invention as set forth in claim 5 in a combination in which the shape of the said engageable portion of the first support member and the said recess is coordinated such that resilient deformation is imparted to either or both of the engageable portion of the first support member and/or the walls of the recess, by the twisting force which moves the parts from the first relative position to the second relative position.

7. The invention as set forth in claim 5 in a combination in which the shape of the said engageable portion of the first support member and the said recess is coordinated such that a toggle-type retention of the engageable portion of the first support member is made by walls of the recess, by the twisting force which moves the parts from the first relative position to the second relative position.

8. The invention is as set forth in claim 5 in a combination in which the shape of the said engageable portion of the first support member and the said recess is coordinated such that resilient deformation is imparted to either or both of the engageable portion of the first support member and/or the walls of the recess, and a toggle-type retention of the engageable portion of the first support member is made by walls of the recess, by the twisting force which moves the parts from the first relative position to the second relative position.

9. Support means by which a first support member is supported by a second support member, the second support member being provided with an elongated recess opening to a face of the second support member;

the portion of the first support member supportively engageable with the said recess of the second support member being such that it is insertable freely thereinto, into a first relative position, by first positioning the said portion into the recess, and then, upon applying a twisting force to the outer portion of the first support member about the general axis of the recess, the said engageable portion of the first support member is caused to snugly engage the said recess as the parts are relatively moved thereby to a second relative position of firm support of the first support member by the second support member;

the first support member having a fulcrum portion displaced transversely of the outer portion;

a connecting portion between said outer portion and said fulcrum portion having a surface adapted to bearingly engage a portion of the said elongated recess;

in a combination in which the inner portion of the said engageable portion of the first support member is shaped such that it is operatively wider than the operative width of the recess at a portion thereof intermediate its portions engaged by the first support member in the first relative position and second relative position of the parts.

10. The invention as set forth in claim 9 in a combination in which the shape of the said engageable portion of the first support member and the said recess is coordinated such that resilient deformation is imparted to either or both of the engageable portion of the first support member and/or the walls of the recess, by the twisting force which moves the parts from the first relative position to the second relative position.

11. The invention as set forth in claim 9 in a combination in which the shape of the said engageable portion of the first support member and the said recess is coordinated such that a toggle-type retention of the engageable portion of the first support member is made by walls of the recess, by the twisting force which moves the parts from the first relative position to the second relative position.

12. The invention is as set forth in claim 9 in a combination in which the shape of the said engageable portion of the first support member and the said recess is coordinated such that resilient deformation is imparted to either or both of the engageable portion of the first support member and/or the walls of the recess, and a toggle-type retention of the engageable portion of the first support member is made by walls of the recess, by the twisting force which moves the parts from the first relative position to the second relative position.

* * * * *